US008720006B2

(12) United States Patent
Wu

(10) Patent No.: US 8,720,006 B2
(45) Date of Patent: May 13, 2014

(54) ELASTIC EXTENSION DEVICE AND RETRACTABLE PULLING ROD USING THE SAME

(76) Inventor: Chen-Chuan Wu, Hsin Chuang (TW)

( * ) Notice: Subject to any disclaimer, the term of this patent is extended or adjusted under 35 U.S.C. 154(b) by 128 days.

(21) Appl. No.: 13/473,177

(22) Filed: May 16, 2012

(65) Prior Publication Data

US 2013/0117968 A1 May 16, 2013

(30) Foreign Application Priority Data

Nov. 15, 2011 (TW) ..... 100221541 U

(51) Int. Cl.
*A45C 13/26* (2006.01)

(52) U.S. Cl.
USPC ..... 16/113.1; 190/115

(58) Field of Classification Search
CPC ..... B25G 1/04; A45C 13/26; A45C 13/262; A45C 13/28; A45C 2013/267
USPC ..... 16/113.1, 114.1, 405, 406, 429, 16/DIG. 41; 190/115, 116, 117
See application file for complete search history.

(56) References Cited

U.S. PATENT DOCUMENTS

| | | | | |
|---|---|---|---|---|
| 5,732,443 | A * | 3/1998 | Kazmark et al. | 16/113.1 |
| 6,295,698 | B1 * | 10/2001 | Chang | 16/113.1 |
| 6,668,423 | B1 * | 12/2003 | Chen | 16/113.1 |
| 7,120,966 | B2 * | 10/2006 | Chou | 16/113.1 |
| 2003/0014841 | A1 * | 1/2003 | Kuo | 16/405 |
| 2005/0102795 | A1 * | 5/2005 | Chou | 16/113.1 |
| 2006/0225981 | A1 * | 10/2006 | Lin | 190/115 |

FOREIGN PATENT DOCUMENTS

EP 0032651 * 7/1981

* cited by examiner

*Primary Examiner* — Jeffrey O Brien
(74) *Attorney, Agent, or Firm* — Muncy, Geissler, Olds & Lowe, P.C.

(57) ABSTRACT

A retractable pulling rod utilizing an elastic extension device, comprising: a pulling rod set, a plug set, and elastic extension device. The pulling rod set is provided with a first socket, a second socket, and a third socket, sleeved onto each other through their ends of small diameters, and each is provided with at least a positioning hole. A first plug and a second plug are disposed respectively at bottom ends of first socket and second socket, to dispose a protrusion tenon of elastic extension device in an indentation slot inside second socket. Through using elastic extension device to assist steel beads of first plug and second plug to position in or detach from positioning hole, retractable pulling rod is extended or retracted smoothly.

11 Claims, 10 Drawing Sheets

ELASTIC EXTENSION DEVICE AND RETRACTABLE PULLING ROD USING THE SAME

BACKGROUND OF THE INVENTION

1. Field of the Invention

The present invention relates to an elastic extension device and a retractable pulling rod using the same, and in particular to an elastic extension device capable of assisting extension and retraction of a retractable pulling rod.

2. The Prior Arts

Presently, in order to facilitate dragging and lifting a luggage trunk, the pulling rod of a luggage trunk is designed to be retractable, having a plurality of sockets, such that the number of sockets to be pulled out while using depends on the user's requirement.

Refer to FIG. 1 for a conventional multi-section luggage trunk pulling rod of the prior art. As shown in FIG. 1, the multi-section luggage trunk pulling rod includes: an inner tube 10, an intermediate tube 12, an outer tube 14, a first positioning device 16, and a second positioning device 18. The inner tube 10 is provided and received in the intermediate tube 12, the intermediate tube 12 is sleeved in the outer tube 14, and the first positioning device 16 and the second positioning device 18 are disposed at the bottom ends of the inner tube 10 and the intermediate tube 12 respectively. Wherein, the lower ends of the inner tube 10, the intermediate tube 12, and the outer tube 14 are provided with a least a corresponding first fastening hole 20 in communication; while the upper ends of the intermediate tube 12, and the outer tube 14 are provided respectively with a second fastening hole 22. The structures of the first positioning device 16 and the second positioning device 18 are the same, both are composed of a sleeve seat 171, an action element 172, a compressible spring 173, and a positioning bead column 174. The top surface of the sleeve seat 171 is connected to the action element 172, the lower end of the action element 172 is provided with an action plate 175, and the compressible spring 173 is sleeved around the action plate 175. The end of the positioning bead column 174 is inserted into a slant slot hole 176 at the lower end of the action plate 175, so that the positioning bead column 174 is able to slide in the slant slot hole 176.

In operation, an action rod 24 controls the actions of the first positioning device 16, so that the first positioning device 16 is connected to the second positioning device 18. To be more specific, when the action rod 24 presses down the action element 172 of the first positioning device 16, the action plate 175 is moved downward, so that the compressible spring 173 is in a compressed state. Meanwhile the positioning bead column 174 is moved upward along the slant slot hole 176 on the action plate 175, so that the positioning bead column 174 is detached from the first fastening holes 20 of the outer tube 14, the intermediate tube 12, and the inner tube 10, and retracts inward into inner tube 10. Similarly, the positioning bead column 174 of the second positioning device 18 is detached sequentially from the first fastening holes 20 of the outer tube 14, the intermediate tube 12, and retracts inward into the intermediate tube 12, so that the inner tube 10 and intermediate tube 12 can be pulled and extended freely in the outer tube 14.

When a user pulls the inner tube 10 and the intermediate tube 12 upward, until the positioning bead columns 174 of the first positioning device 16 and the second positioning device 18 correspond respectively to the second fastening holes 22 of the outer tube 14 and the intermediate tube 12, such that the compressible spring 173 is restored elastically, to make the positioning bead column 174 move downward along the slant slot hole 176 on the action plate 175, so that the positioning bead column 174 extends and protrudes to position on the second fastening hole 22, in achieving extension of the pulling rod. In the same manner, the action rod 24 has only to be pressed again to control the first positioning device 16 to connect to the second positioning device 18, to proceed with retraction and positioning actions as shown in FIG. 1.

Though, through the structure mentioned above, the extension and retraction of the pulling rod can be achieved. However, in actual applications, the length of the positioning bead column 174 has to be designed to protrude and extend through the first fastening holes 20 of the inner tube 10, and intermediate tube 12, and the outer hole 14, and the positioning bead column 174 has to be retracted into the corresponding socket. For a retractable pulling rod exceeding three sockets, the positioning bead column 174 has to extend and position in, or retract and detach from the through the fastening hole on the socket. Yet, by doing so, the friction and resistance in operation is relatively large (requiring more efforts), so that in extending or retracting the rod, it can not be positioned and fixed smoothly, hereby resulting in unstable operations. Also, the structure design of the retractable pulling rod is restricted by the length of positioning bead column 174.

Therefore, presently, the design and performance of luggage trunk pulling rod of the prior art is not quite satisfactory, and it has much room for improvements.

SUMMARY OF THE INVENTION

In view of the problems and shortcomings of the prior art, A major objective of the present invention is to provide an elastic extension device and a retractable pulling rod using the same, that is provided with multi-sockets, and can be operated more correctly and smoothly to facilitates extending and retracting of the rod.

In order to achieve the above-mentioned objective, the present invention provide an elastic extension device, including: a base, a spring, a pushing piece. Wherein, the base is provided with an indention portion, and an installation portion located thereon, the installation portion has a through-hole, a spring is sleeved around the installation portion of the base, and a pushing piece is provided on the base. The pushing piece is provided with a press portion, and a rod body located on its lower end. One end of the rod body is received and provided in the through-hole, and is also located in the spring, so that the press portion is used to bring the rod body to move in the through-hole. The spring is compressed or restored according to the action of the pushing piece.

The present invention also provides a retractable pulling rod utilizing an elastic extension device, comprising: a pulling rod set, a plug set, and the elastic extension device. The pulling rod set is provided with a first socket, a second socket, and at least a third socket, sleeved onto each other through their ends of small diameters, and is each provided with at least a positioning hole. The plug set includes a first plug and a second plug, disposed at the corresponding bottom ends of the first socket and the second socket. The first plug and a second plug are provided respectively with at least a connection piece and at least a steel bead. The elastic extension device can be disposed in the second socket, and is located over the second plug. A press rod can be used to control the first plug to connect to the elastic extension device and the second plug, so that the first plug is pressed against the press portion of the pushing piece; meanwhile, it brings the rod body to move from within the through-hole to outside, thus pressing down the connection piece of the second plug, to bring the steel beads to position in or detach from the positioning hole, so as to make the pulling rod extend or retract.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PRE-ERRED EMBODIMENT

The purpose, construction, features, functions and advantages of the present invention can be appreciated and understood more thoroughly through the following detailed description with reference to the attached drawings. And, in the following, various embodiments are described in explaining the technical characteristics of the present invention.

Figure 1:
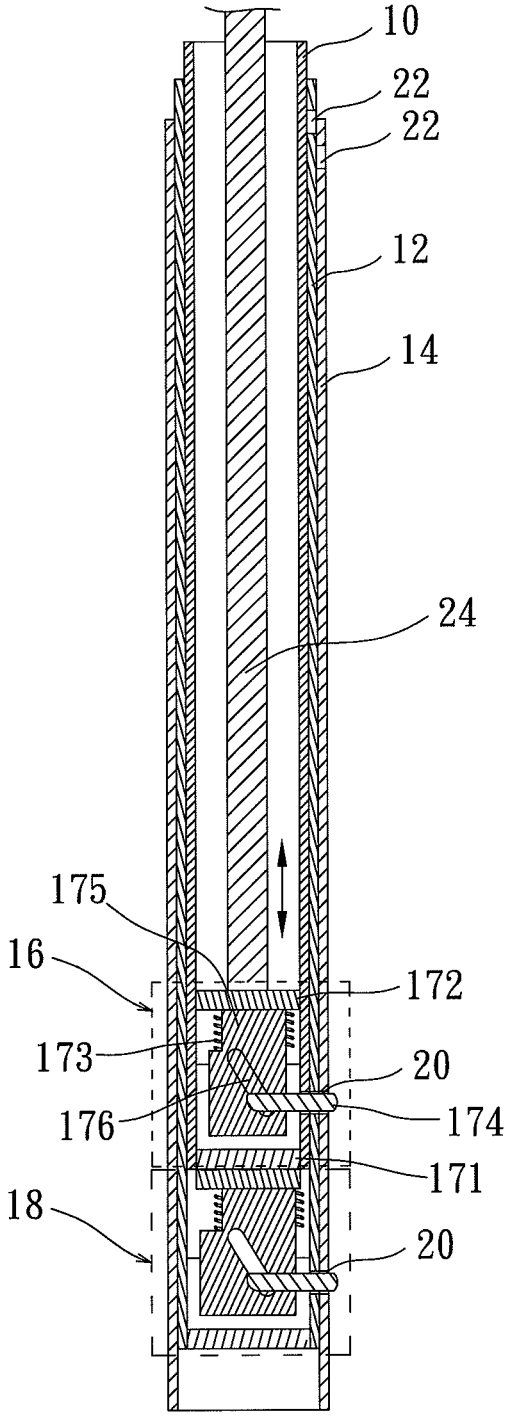
Fig. 1 (Prior art)
FIG. 1 is a schematic diagram of a multi-section luggage trunk pulling rod of the prior art.
Figure 2:
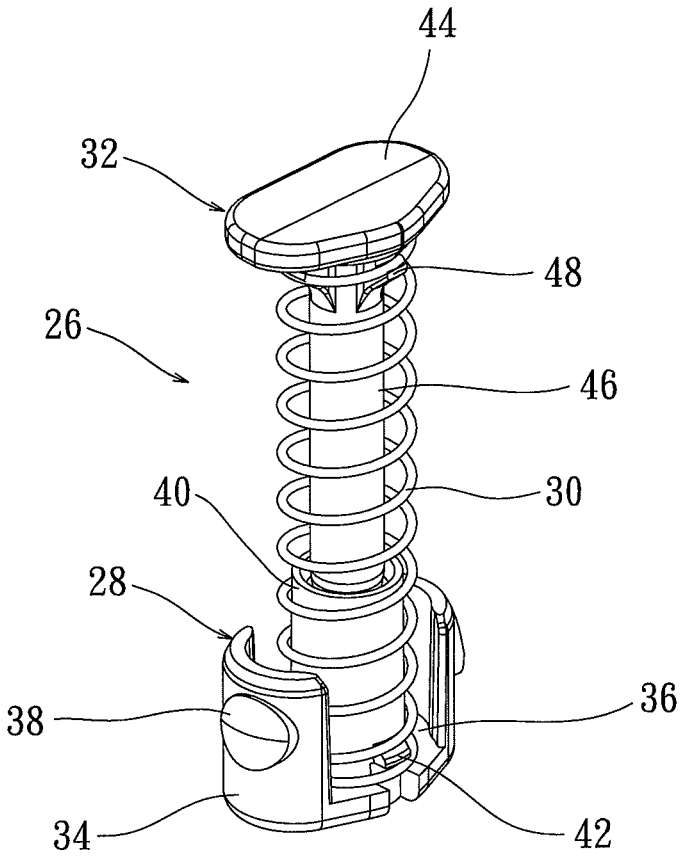
FIG. 2 is a perspective view of an elastic extension device according to the present invention.
Figure 3:
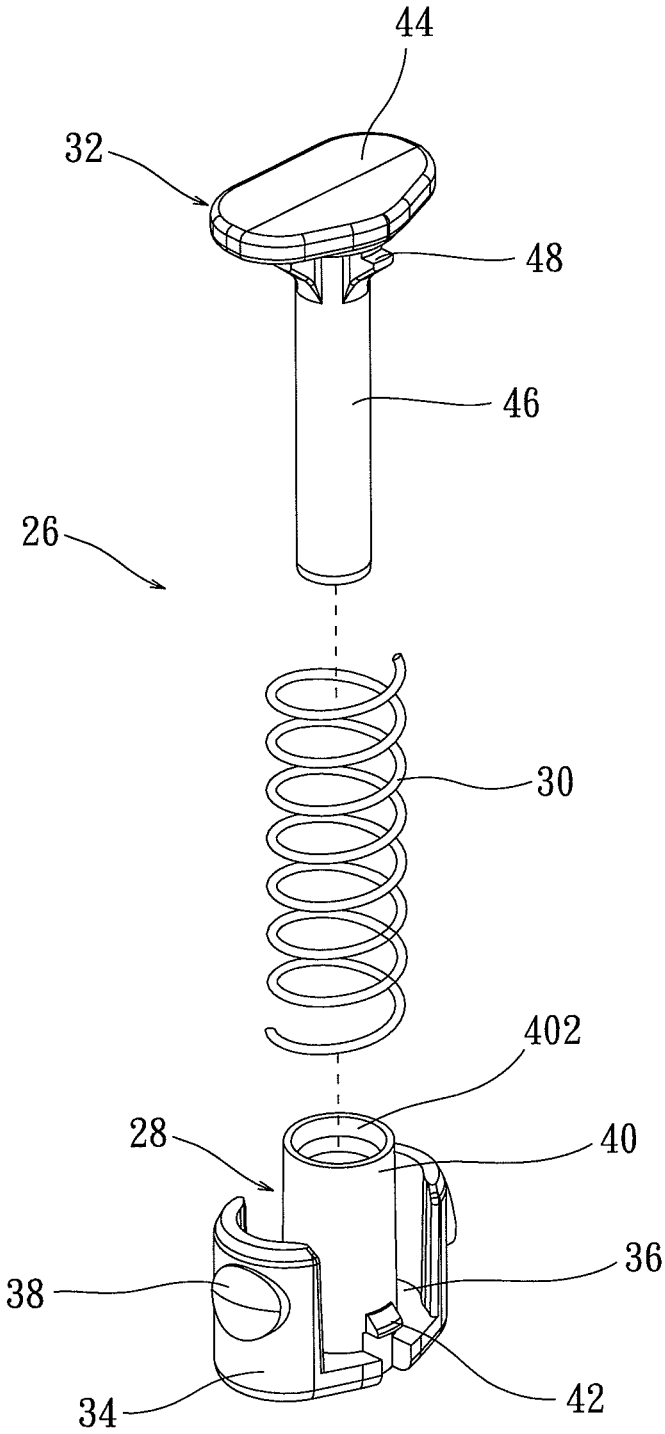
FIG. 3 is an exploded view of an elastic extension device according to the present invention.

Refer to FIGS. 2 and 3 respectively for a perspective view of an elastic extension device according to the present invention, and an exploded view of an elastic extension device according to the present invention. As shown in FIGS. 2 and 3, the elastic extension device 26 includes a base 28, a spring 30, and a pushing piece 32. On two sides of the base 28 are each extended upward an extension portion 34, so that an indentation portion 36 is formed inside. On the side of the extension portion 34 is provided with at least a protrusion tenon 38, to fix onto a corresponding indentation slot on the retractable pulling rod, and that will be described in detail later. From the center of the base 28 is extended upward an installation portion 40, which is for example of a cylinder shape. In the center of the installation portion 40 is provided with a through-hole 402, and the installation portion 40 is located in the central position of the indentation portion 36. A first fastening tenon 42 is provided close to the bottom end of the installation portion 40. A spring 30 is sleeved around the installation portion 40 of the base 28. To be more specific, the lower end of the spring 30 is connected onto the first fastening tenon 42, so that the spring 30 is fixed securely onto the installation portion 40.

The pushing piece 32 is located above the base 28, and is provided with a press portion 44 and a rod body 46 at its lower end. Wherein, the rod body 46 is extended vertically from the lower end of the press portion 44 to form integrally into a T-shape pushing piece. One end of the rod body 46 is installed in the through-hole 402, and is located inside the spring 30. Wherein, a second fastening tenon 48 is provided between the press portion 44 and the rod body 46. The second fastening tenon 48 is for the fastening and fixing of the upper end of the spring 30, so as to make the pushing piece 32 to connect and fix onto the installation portion 40.

In operation, the press portion 44 can be controlled to move, so it brings the rod body 46 to move up and down in the through-hole 402. Meanwhile, the spring 30 performs elastic compression or restoration corresponding to the actions of the pushing piece 32.

Figure 4A:
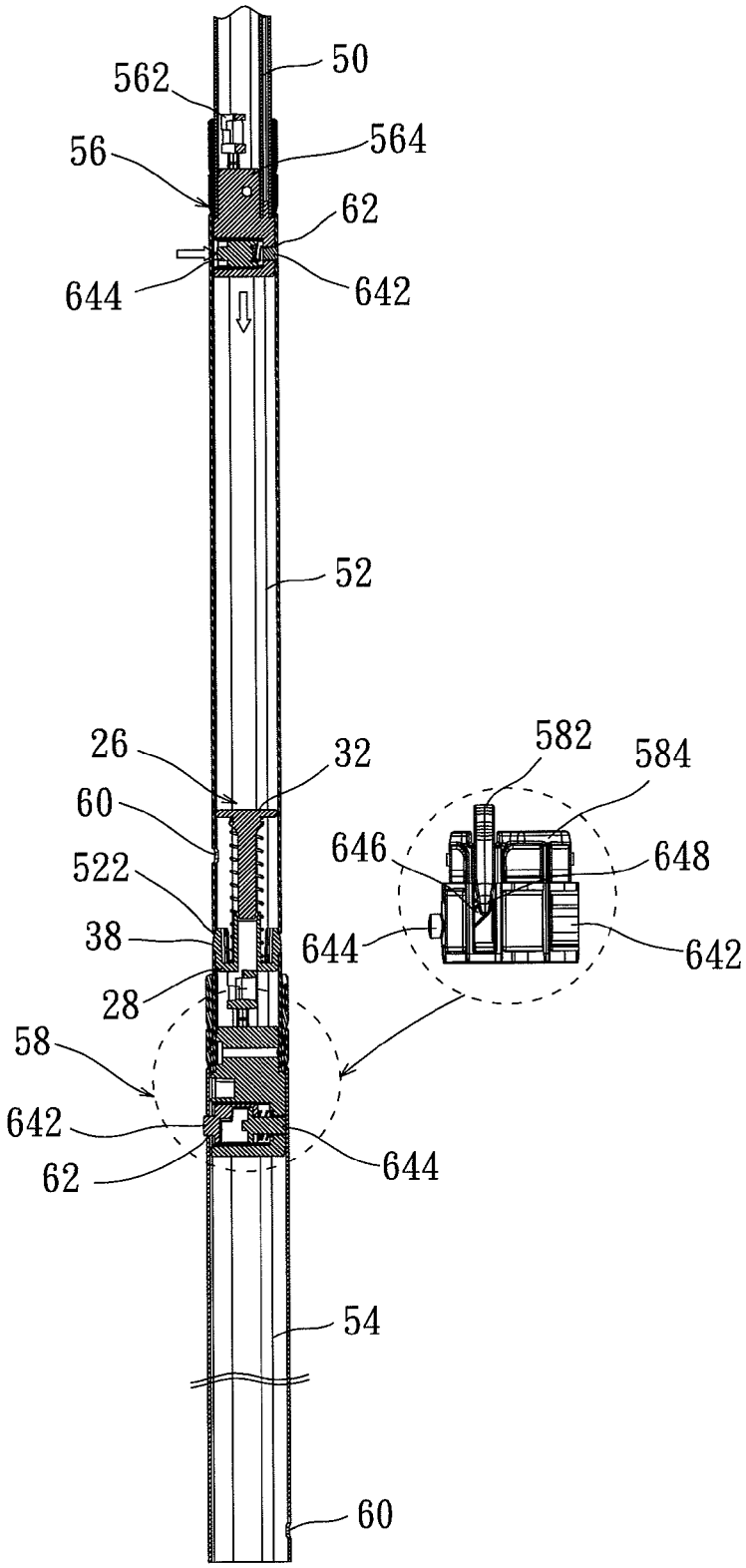
FIGS. 4A to 4D are schematic diagrams of a retractable pulling rod utilizing an elastic extension device according to the present invention.

In order to explain further the advantages of the elastic extension device 26 in achieving stable and labor saving operations in a multi-section-tube, refer to FIGS. 4A to 4D for schematic diagrams of a retractable pulling rod utilizing an elastic extension device according to the present invention. As shown in FIG. 4A, a fully extended retractable pulling rod is described. The retractable pulling rod includes a pulling rod set and a plug set. The pulling rod set includes a first socket 50, a second socket 52, and at least a third socket 54, sleeved and fixed onto each other through their ends of small diameter. Herein, the retractable pulling rod of three sockets are taken as example for explanation. The plug set includes a first plug 56 and a second plug 58, disposed respectively at the bottom ends of the corresponding first socket 50 and the second socket 52. A protrusion tenon 38 is provided at the base 28 of the elastic extension device 26, and is fixed onto a corresponding indentation slot 522 of the second socket 52, so that the elastic extension device 26 is located securely in the second socket 52, and above the second plug 58.

In order to match the positioning design of the plug set, the lower end of the second socket 52 and the third socket 54 are provided each with a first position hole 60, to serve as a retraction positioning holen. On the upper ends of the second socket 52 and the third socket 54 are provided each with a second positioning hole 62, to serve as an extension positioning hole, so that each of the sockets can proceed with fixing or detaching positioning, that will be described later.

In the descriptions above, the first plug 56 is provided with at least a first connection piece 562 and at least a first steel bead 564, and the second plug 58 is provided with at least a second connection piece 582 and at least a second steel bead 584. Since the structures of the first plug 56 and the second plug 58 are the same, therefore, the second plug 58 is taken as an example for explanation. On at least one side of the second steel bead 584 is extended a protrusion portion. Herein, two sides of the second steel beads 584 are extended a first protrusion portion 642 and a second protrusion portion 644, to match with the positioning holes of the third socket 54. The front side and back side of the second steel bead 584 are provided respectively with a corresponding slide slot 646, for the positioning and fixing of a sliding block 648 on two sides of bottom end of the second connection piece 582. It is worth mentioning that, the elastic extension device 26 is located between the first plug 56 and the second plug 58. To be more specific, the base 28 of the elastic extension device 26 is located above the second connection piece 582, and the pushing piece 32 of the elastic extension device 26 is located below the first steel bead 564 of the first plug 56.

As shown in FIG. 4A, the second protrusion portions 644 on the first plug 56 of the first socket 50 and on the second plug 58 of the second socket 52, are extended and positioned respectively into the second positioning holes 62 of the first socket 50 and the second socket 52, such that each of the sockets is in an extended positioning state.

Figure 4B:
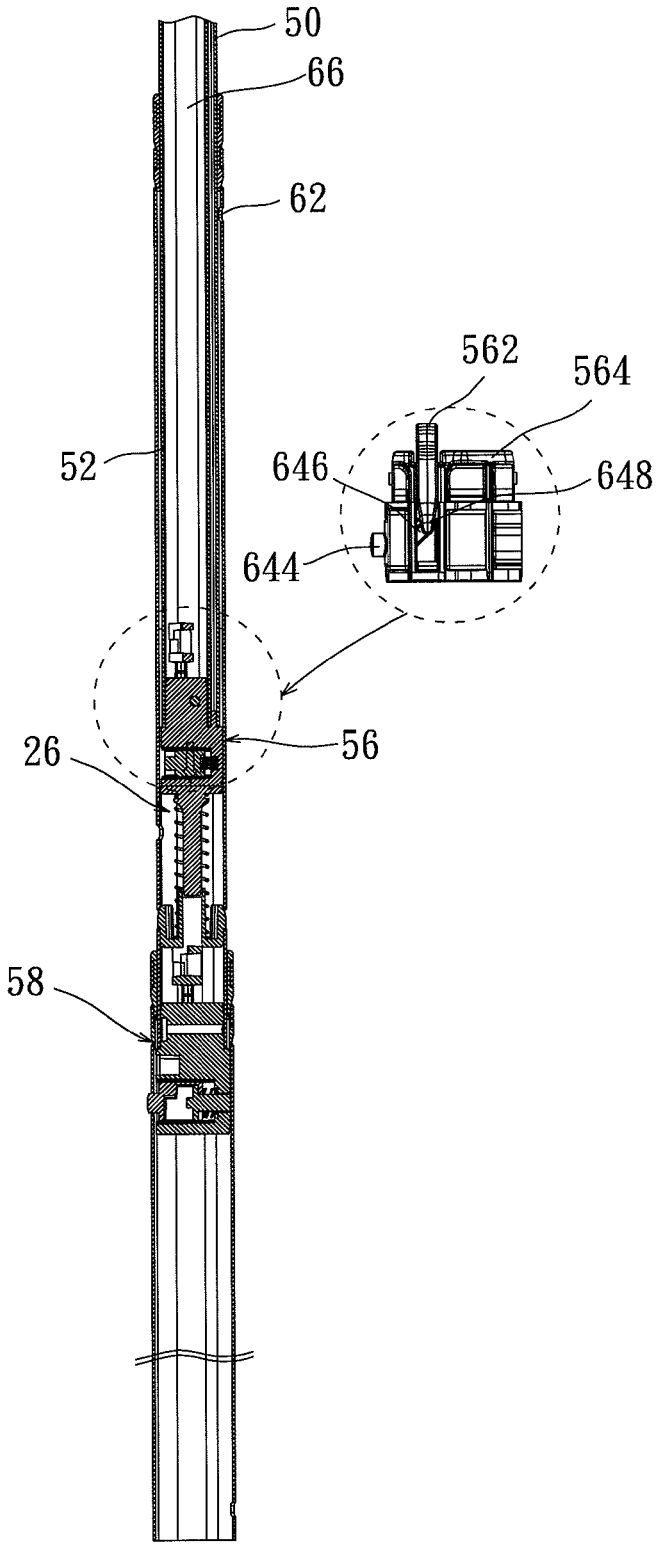
Figure 4C:
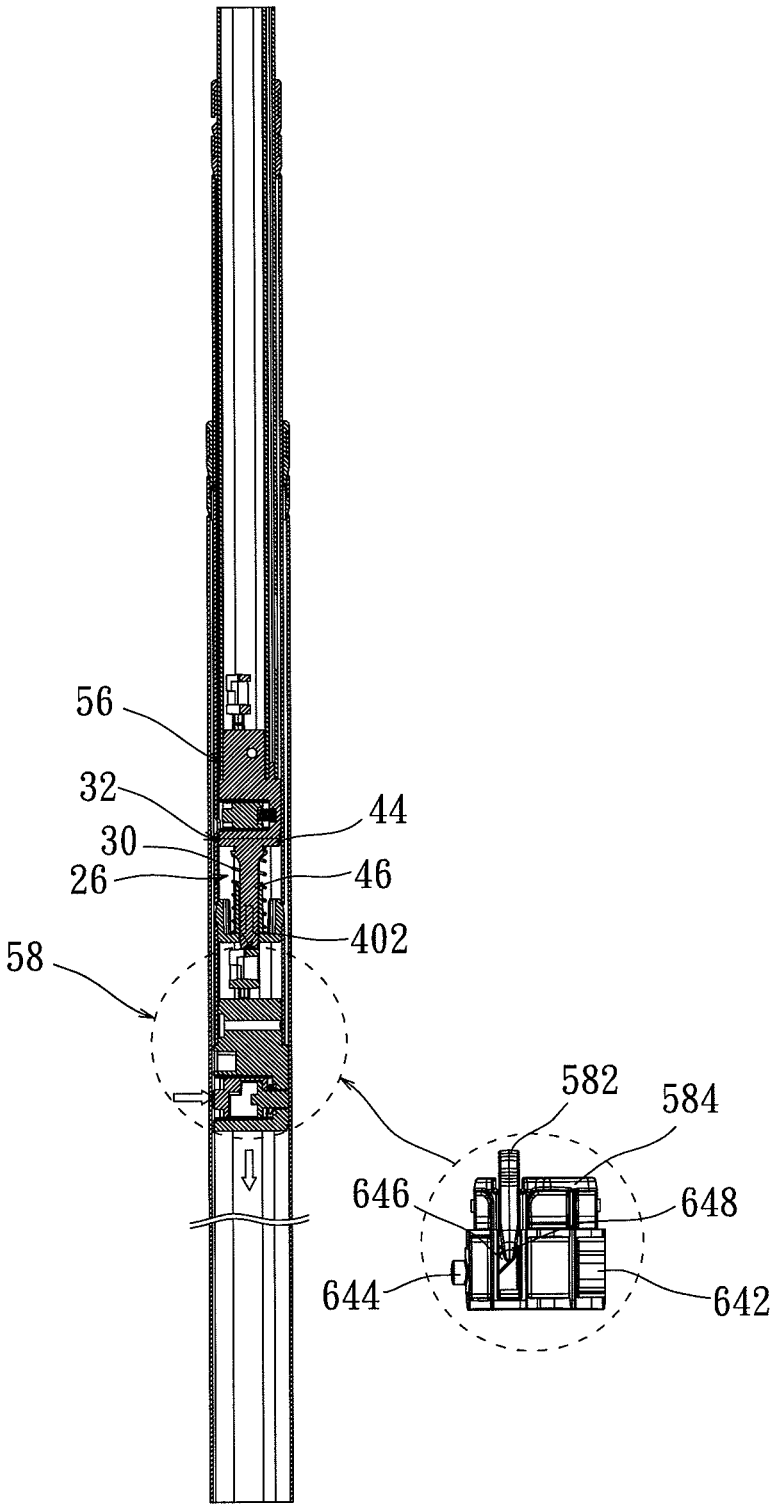

In the following, the retraction positioning of the pulling rod is described. As shown in FIG. 4B, in retracting a pulling rod, a press rod 66 controls the first plug 56 to act, then the first plug 56 connects the elastic extension device 26 and the second plug 58 in sequence. More specifically, when the first plug 56 is pressed by the press rod 66, a slide block 648 of the first connection piece 562 on the first plug 56 will move downward along the slide slot 646. Meanwhile, it connects a second protrusion 644 of the first steel bead 564 to retract from the second positioning hole 62 into the second socket 52, to release it from the extension positioning state, so that the first socket 50 can move freely in the second socket 52. Then, as shown in FIG. 4C, when the first plug 56 is moved downward, it will press against the pushing piece 32 of the elastic extension device 26, so that its press portion 44 will bring the rod body 46 to move downward in the through-hole 402, until it extends outside the through-hole 402. At this time, the spring 30 will be compressed elastically corresponding to the action of the pushing piece 32.

Figure 4D:
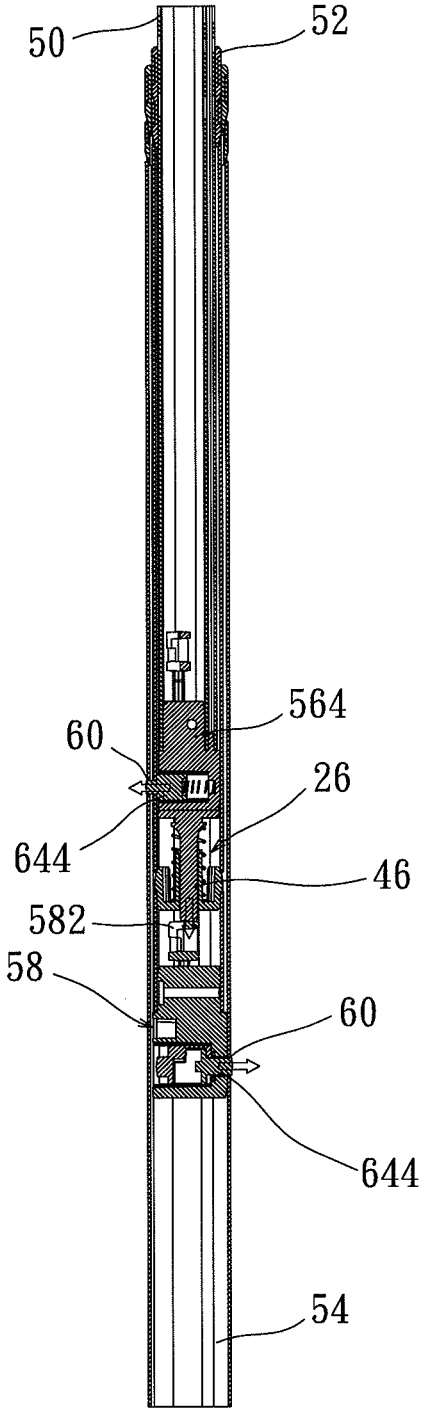

Subsequently, as shown in FIG. 4D, when the rod body 46 of the elastic extension device 32 is moved downward, it will press against the second connection piece 582 of the second plug 58, hereby making a slide block 648 of the second connection piece 582 to move downward along a slide slot 646. Meanwhile, it connects a second protrusion 644 of the second steel bead 584 to retract from the second positioning hole 62 into the third socket 54, to release it from the extension positioning state, so that the second socket 52 can move freely in the third socket 54. At this time, the second protrusion portion 644 of the first steel bead 564 is just in the first positioning hole 60 of the second socket 52, thus extending and positioning therein, in achieving retracting the first socket 50 into the second socket 52. Finally, the second socket 52 is moved downward continuously, until the second protrusion portion 644 of the second steel bead 584 is extended and positioned in the first positioning hole 60, so that the second socket 52 is retracted entirely into the third socket 54, in realizing retracting the pulling rod completely.

Then, the extension positioning of the pulling rod is described. As shown in FIG. 4A, in extending a pulling rod, a press rod 66 controls the first plug 56 to move, then the first plug 56 connects the elastic extension device 26 and the second plug 58 in sequence. More specifically, when the first plug 56 is pressed by the press rod 66, the first connection piece 562 on the first plug 56 will connect the first steel bead 564, to make the second protrusion portion 644 to retract from the first positioning hole 60 into the second socket 52, to release it from the retraction positioning state. It is worth mentioning that, upon being pressed by the first plug 56, the elastic extension device 26 not only connects the second plug 58, to make its second connection piece 582 to connect the second steel bead 584, thus enabling the second protrusion portion 644 of the second steel bead 584 to retract from the first positioning hole 60 into the third socket 54, to release it from the retraction positioning state, but the spring 30 of the elastic extension device 26 is also made to restore, so that the first socket 50 in the second socket 52 is in a release state. As such, a user can pull the first socket 50 and the second socket 52 up sequentially from the third socket 54, until the second protrusion portions 644 of the first plug 56 and the second plug 58 extend and position in the second positioning holes 62 of the first socket 50 and the second socket 52, in realizing the extension of the respective sockets.

In the descriptions mentioned above, in case it is desired to design a retractable multi-section-tube pulling rod, a third plug and another elastic extension device can be disposed at the bottom end of the third section tube 54, to be connected to the next socket. Then, through the same movements performed by the second plug 58 and elastic extension device 26 between the second socket 52 and the third socket 54, the extension and retraction of such a multi-section-tube pulling rod can be achieved.

Figure 5:
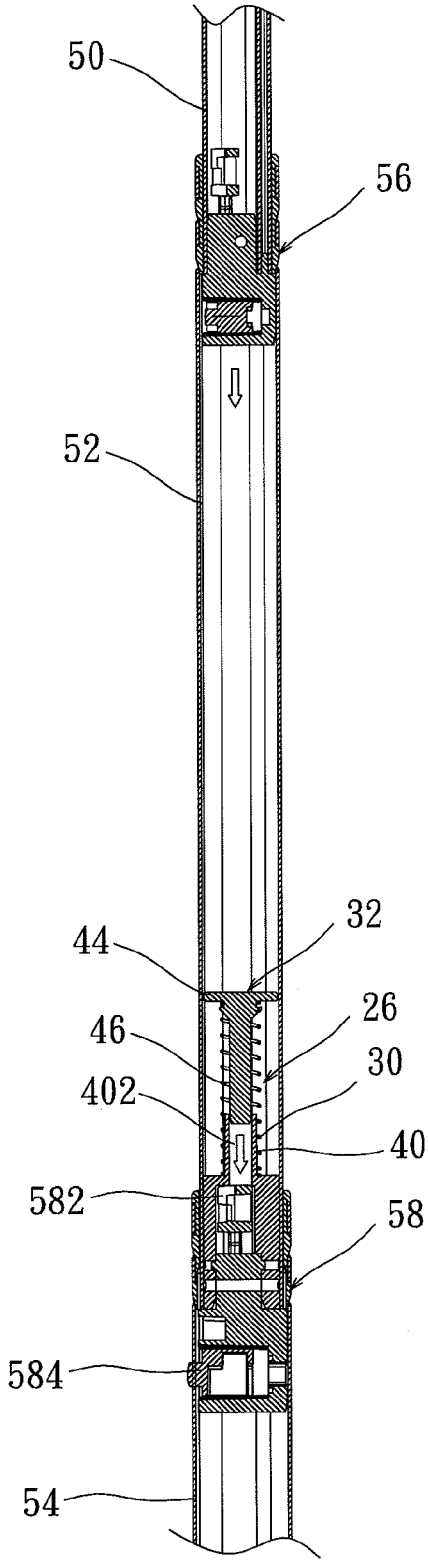
FIG. 5 is a schematic diagram of another retractable pulling rod utilizing an elastic extension device according to the present invention.
Figure 6A:
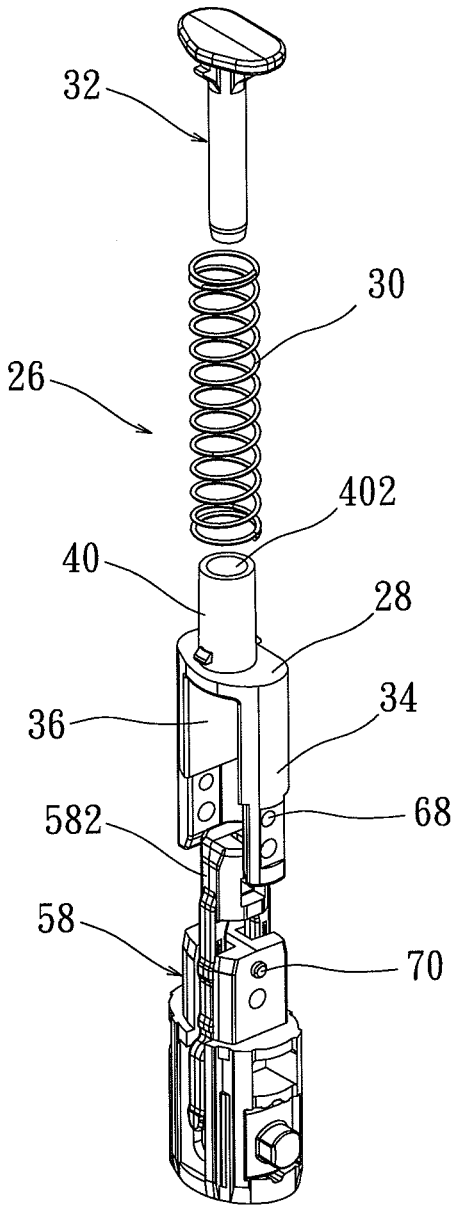
FIG. 6A is an exploded view of a portion of the retractable pulling rod in FIG. 5.
Figure 6B:
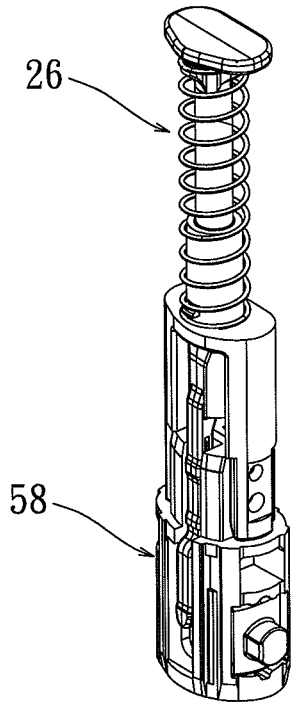
FIG. 6B is a perspective view of a portion of the retractable pulling rod in FIG. 5.

In addition to the design mentioned above to put the elastic extension device 26 and the second plug 58 separately in the second socket 52, the elastic extension device 26 can be placed directly above the second plug 58. Refer respectively to FIG. 5 for a schematic diagram of another retractable pulling rod utilizing an elastic extension device according to the present invention; FIG. 6A for an exploded view of a portion of the retractable pulling rod in FIG. 5; and FIG. 6B for a perspective view of a portion of the retractable pulling rod in FIG. 5. It is worth to note that, the operation principle of the retractable pulling rod of the present embodiment is the same as that mentioned above, therefore only their differences are described herein for brevity. From the assembly approach of FIG. 4A, it can be known that, the elastic extension device 26 must be installed in the second socket 52 and fixed, then the second plug 58 is placed at the end of the second socket 52. Due to the requirements of the various Industries, the elastic extension device 26 can be installed directly onto the second plug 58, then together they are put into the second socket 52. As shown in FIG. 6A, from the base 28 of the elastic extension device 26 extending upward is an installation portion 40, that is for example of a cylinder shape. In the center of the installation portion 40 is a through-hole 402, and a spring 30 is sleeved around the installation portion 40 of the base 28. The pushing piece 32 is disposed above the base 28. On two sides of the base 28 extending downward is an extension portion 34, to form an indentation portion 36 inside, and the through-hole 402 of the installation portion 40 is in communication with indentation portion 36. Wherein, width and depth of the indentation portion 36 must be greater than the width and depth of the second connection piece 582 of the second plug 58, so that the second connection piece 582 can be received in the indentation portion 36. At least a hole 68 is provided on the extension portion 34 of the elastic extension device 26, and at least a protrusion column 70 is disposed on the second plug 58, so that during assembly, the protrusion column 70 can be fastened and fixed into the hole 68 correspondingly. As such, the elastic extension device 26 can be connected directly above the second plug 58, as shown in FIG. 6B.

Subsequently, refer to FIG. 5 for a schematic diagram of another retractable pulling rod utilizing an elastic extension device according to the present invention, wherein, a retractable pulling rod made of three sockets is taken as an example for explanation, comprising a first socket 50, a second socket 52, and at least a third socket 54. During assembly, a first plug 56 is first installed at the bottom end of the first socket 50, and next, sleeve the first socket 50 into the second socket 52. Then, dispose the integrally assembled elastic extension device 26 and the second plug 58 to the bottom end of the second socket 52, such that the elastic extension device 26 is located between the first plug 56 and the second plug 58. Finally, sleeve the second socket 52 into the third socket 54, hereby realizing a retractable pulling rod. When the first plug 56 is moved downward, it will press against the pushing piece 32 of the elastic extension device 26, to make its press portion 44 to bring the rod body 46 to move downward in the through-hole 402 of the installation portion 40, until it extends outside the through-hole 402 and presses against the second connection piece 582. At this time, due to the actions of the pushing piece 32, the spring 30 is compressed correspondingly. When the second connection piece 582 is pressed continuously, it will bring the second steel bead 584 into action to complete the extension positioning or retraction positioning of the pulling rod.

Summing up the above, the retractable pulling rod of the present invention is simple in construction and easy to operate, such that during operation only the press rod has to be operated. As such, in operation, an elastic extension device is used to assist positioning of various sockets, to facilitate the extension or retraction of the multi-section-tube pulling rod more precisely and smoothly. Furthermore, the length of the protrusion portion of the steel bead need not be designed too long. In case only three sockets are utilized, then the length of the protrusion portion can be designed to just fit and extend into the positioning holes of the second socket and the third socket, and then the elastic extension device assists the extension or retraction of the protrusion portion, to reduce friction and resistance during operation. In case the retractable pulling rod is made of more than three sockets, then the length of the protrusion portion need only be designed to match the positioning holes of the adjacent socket, hereby solving the problem of friction and instability in operation. Moreover, the retractable pulling rod of the present invention can be designed to have more than three sockets, thus having a good competitive edge on the market.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A retractable pulling rod comprising:

a pulling rod set, provided with a first socket, a second socket, and at least a third socket, sleeved onto each other through their ends of small diameters, and each is provided with at least a positioning hole;

a plug set, provided with a first plug and a second plug, disposed respectively at bottom ends of said first socket and said second socket, said first plug and said second plug are each provided respectively with at least a connection piece and at least a steel bead; and an elastic extension device, comprising:

a base, provided with an indention portion, and on which is provided with an installation portion having a through-hole;

a spring, sleeved around said installation portion of said base; and a pushing piece, provided with a press portion on an upper end and a rod body on a lower end, one end of said rod body is received in said through-hole, and is also located in said spring, so that said press portion brings said rod body to move in said through-hole, said spring is compressed or restored according to actions of said pushing piece;

said elastic extension device is disposed in said second socket, and is located above said second plug, a press rod is used to control said first plug to connect to said elastic extension device and said second plug, so that said first plug is pressed against the pushing piece of said elastic extension device; said rod body of said elastic extension device moves from within said through-hole to outside, thus pressing down said connection piece of said second plug, to bring said steel bead to position on said positioning hole, or to detach from said positioning hole, so as to make said retractable pulling rod extend or retract.

2. The retractable pulling rod as claimed in claim 1, wherein two sides of said base are extended upward to form an extension portion, to form an indentation portion inside, said installation portion is located in center of said base, and is extended upward to form said installation portion, and is in center of said indentation portion.

3. The retractable pulling rod as claimed in claim 1, wherein said rod body is extended vertically from a lower portion of said press portion to form said pushing piece as a T-shape.

4. The retractable pulling rod as claimed in claim 1, wherein a first fastening tenon is provided on said installation portion, and a second fastening tenon is provided between said press portion and said rod body, said first fastening tenon and said second fastening tenon are for fastening and fixing of an upper end and a lower end of said spring, so that said pushing piece is connected and fixed on said installation portion.

5. The retractable pulling rod as claimed in claim 2, wherein at least a protrusion tenon is provided on a side of said extension portion, and is fixed in a corresponding indentation slot on the retractable pulling rod.

6. The retractable pulling rod as claimed in claim 1, wherein at least an indentation slot is provided inside said second socket, and a protrusion tenon is provided on a side of said base, so that said protrusion tenon is fixed in said indentation slot.

7. The retractable pulling rod as claimed in claim 1, wherein said press rod is provided in said first socket, to control actions of said first plug of said first socket.

8. The retractable pulling rod as claimed in claim 1, wherein at least one side of said steel bead is extended a protrusion portion, with a front and back side provided with corresponding slide slots, for positioning of slide blocks on two sides of a bottom end of said connection piece, when said connection piece is moved downward, said slide block is moved in said slide slot, to bring said protrusion portion to position in or detach from said positioning hole.

9. The retractable pulling rod as claimed in claim 1, wherein a third plug is further provided at bottom end of said third socket, and is located below said second plug, said third plug is connected to move according to actions of said second plug.

10. The retractable pulling rod as claimed in claim 1, wherein said base is extended upward to form said installation portion, two sides of said base are extended downward to form an extension portion, so as to form an indentation portion inside, and is in communication with said through-hole of said installation portion.

11. The retractable pulling rod as claimed in claim 10, wherein said elastic extension device is connected to said second plug, and one end of said connection piece of said second plug is in said indentation portion.

* * * * *